US005964627A

United States Patent [19]

Detwiler

[11] Patent Number: 5,964,627

[45] Date of Patent: Oct. 12, 1999

[54] VARIABLE HEIGHT OUTBOARD MOTOR MOUNT

[75] Inventor: Timothy P. Detwiler, Coatesville, Pa.

[73] Assignee: Detwiler Industries Incorporated, Honey Brook, Pa.

[21] Appl. No.: 09/111,899

[22] Filed: Jul. 8, 1998

[51] Int. Cl.[6] ..... B63H 5/125

[52] U.S. Cl. ..... 440/58; 440/59

[58] Field of Search ..... 440/49, 53, 58, 440/59, 60, 61, 63

[56] References Cited

U.S. PATENT DOCUMENTS

| | | | |
|---|---|---|---|
| 2,928,630 | 3/1960 | Wisman | 440/59 |
| 2,928,631 | 3/1960 | Hartman | 440/59 |
| 3,242,899 | 3/1966 | Hanson . | |
| 3,834,345 | 9/1974 | Hager et al. . | |
| 4,232,627 | 11/1980 | Glenn et al. . | |
| 4,482,330 | 11/1984 | Cook . | |
| 5,484,311 | 1/1996 | Detwiler et al. . | |
| 5,791,954 | 8/1998 | Johnson, Jr. | 440/58 |

OTHER PUBLICATIONS

GMC Power Lift brochure; Cook Manuf. Co., Duncan, OK 1987.

Model–600 brochure; Hydro–Electric Transom; Land & Sea, North Salem, NH (Date Unknown).

*Primary Examiner*—Stephen Avila

*Attorney, Agent, or Firm*—Howson and Howson

[57] ABSTRACT

A manually adjustable outboard motor mount comprises two brackets one attachable to a boat transom and one to which an outboard motor can be attached. The motor bracket is constrained to movement in a straight, substantially vertical path relative to the transom bracket by the cooperation of rods on one bracket with spaced bearings in sleeves on the other bracket. The motor bracket is adjusted vertically by a shaft threaded into the transom bracket and rotatable in a combined thrust and journal bearing in the motor bracket. A nut on the threads of the shaft can be tightened against a plate of the transom bracket to lock the motor bracket against vertical movement. The nut has three radial arms disposed at 120 degree angles relative to one another to allow convenient manual tightening.

7 Claims, 4 Drawing Sheets

VARIABLE HEIGHT OUTBOARD MOTOR MOUNT

SUMMARY OF THE INVENTION

This invention relates to improvements in marine propulsion systems. It is specifically concerned with improvements in an apparatus for varying the height of an outboard motor on the transom of a boat.

Cavitation is a common problem with marine propulsion systems. Boat motors tend to draw water from the surface, which allows air as well as water to pass through the propeller. This results in cavitation or slippage of the propeller, reducing the efficiency of operation of the motor.

It is therefore important to avoid cavitation when operating marine propulsion systems, such as motor boat propellers. Outboard engines normally include a cavitation plate to prevent cavitation. This plate should be positioned to travel across the surface of the water while the motor is operating. At this location, the cavitation plate prevents air from reaching the propeller.

The height at which a cavitation plate is most effective varies depending upon various factors. A boat operating at low speeds, but requiring maximum thrust, will perform best when the cavitation plate is positioned one to three inches above the bottom of the boat. At higher speeds, however, the stern is lower in the water, and the optimum position for the cavitation plate is typically three to five inches above the bottom of the boat.

U.S. Pat. No. 5,484,311, issued Jan. 16, 1996, describes a variable height outboard motor mount comprising brackets connected respectively to a boat transom and an outboard motor, a fluid actuator for adjusting the relationship between the two frames, and guides comprising rods with vertically spaced bearings for firmly constraining the brackets to relative movement in a straight line.

The motor mount of U.S. Pat. No. 5,484,311 has the advantage that it allows the outboard motor to be set to any selected height from a remote location by a closed-loop servo control. However, it also has the disadvantage that it is primarily designed for racing, and is more elaborate and expensive than necessary for fishing or pleasure boats. Height adjustment for improved operating efficiency is nevertheless desirable in the operation of fishing and pleasure boats.

The cost of a variable height outboard motor mount having the advantages of strength afforded by the guide construction described in U.S. Pat. No. 5,484,311 can be reduced by eliminating the servo control system, and providing for manual adjustment. However, in a manually controlled outboard motor mount utilizing a hydraulic actuator system any fluid leakage in the actuator, or in its associated pump or valving can permit drift in the height of the outboard motor. Other schemes for manual adjustment can be used, but all are subject to drift as a result of the strong vibrations inevitably accompanying outboard motor operation.

The principal object of this invention is to provide an outboard motor mount that can be adjusted manually for optimum performance, but which is resistant to drift.

The motor mount in accordance with the invention comprises first and second brackets, one being connectible to the transom of a boat, and the other being adapted for mounting an outboard motor. A guide connected to the first and second brackets constrains the brackets to relative movement in a substantially straight path, which is substantially vertical when the one bracket is connected to a transom. To effect movement of the brackets relative to each other in the substantially straight, vertical path, a rod, extending along a substantially vertical axis, is journalled in the first bracket and has screw threads in threading engagement with threads of a threaded opening in the second bracket. A thrust bearing prevents axial translation of the rod relative to the first bracket, and a crank connected to the rod, enables manual torque to be applied to the rod. A nut in threading engagement with the threads of the rod, is engageable with one of the first and second brackets to lock the rod against rotation, whereby the first and second brackets may be locked against translation relative to each other.

The first bracket preferably comprises first and second plates rigidly connected together and disposed with the first plate above the second plate. Similarly, the second bracket comprises third and fourth plates rigidly connected together with the third plate above the fourth plate. The third and fourth plates are located between the first and second plates. The guide means comprises at least one elongated tubular member extending from the third plate to the fourth plate, and being rigidly connected to the third and fourth plates, a rod extending through the tubular member, the rod being rigidly connected to the first and second plates, and a pair of bearings mounted in the tubular member, the bearings being spaced from each other in the direction of the length of the tubular member, the rod extending lengthwise through the bearings and being slidable therein, the rod and tubular member being held by said bearings against relative lateral translational movement.

Preferably the nut is located on the rod between the first and second plates and releasably tightenable against the top of the third plate.

In a preferred embodiment of the invention, the nut includes at least radial arm, permitting the operator to tighten the nut without a wrench. Ideally, the nut has three crank arms, each disposed at an angle of 120 degrees relative to each of the others.

As will be apparent from the following detailed description, the invention provides an inexpensive, convenient and easily operated manual height adjustment for an outboard motor, which is resistant to drift as a result of vibrations encountered in operation.

Other objects, details and advantages of the invention will be apparent from the following detailed description when read in conjunction with the drawings.

DETAILED DESCRIPTION

The outboard motor mount in accordance with the invention is similar in many respects to the motor mount described in U.S. Pat. No. 5,484,311, and accordingly the disclosure of that patent is here incorporated by reference.

Figure 1:
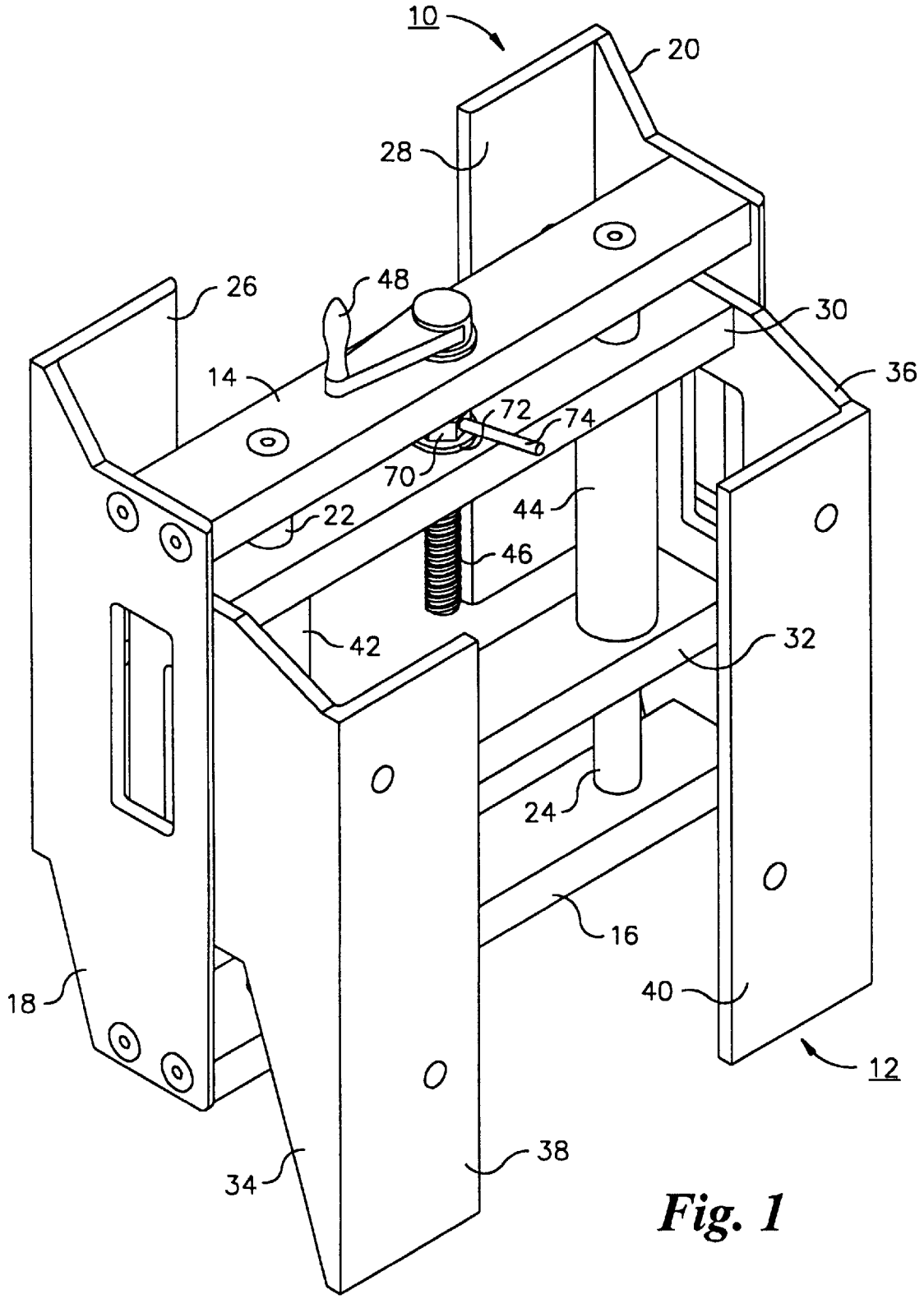
FIG. 1 is a perspective view, showing the variable height outboard motor mount in a raised condition.

As shown in FIG. 1, the motor mount comprises a first bracket 10 to which an outboard motor can be connected, and a second bracket 12 connectible to the transom of a boat. The first bracket 10 includes a first, or upper, plate 14 and a second, or lower, plate 16. These plates, 14 and 16, are rigidly connected together by side plates 18 and 20 and rods 22 and 24. Flanges 26 and 28, on side plates 18 and 20 respectively, enable an outboard motor to be bolted to the bracket 10.

The second bracket 12 includes a third plate 30 and a fourth plate 32. Plates 30 and 32 are rigidly connected together by side plates 34 and 36 so that the third plate 30 is disposed above the fourth plate 32. Side plates 34 and 36 are provided with flanges 38 and 40 respectively, for connection of bracket 12 to the transom of a boat. As shown in FIG. 1, plates 30 and 32 of the transom bracket 12 are located between plates 14 and 16 of the motormounting bracket, but plates 30 and 32 are closer together than are plates 14 and 16, so that bracket 10 can move up and down relative to bracket 12 through a substantial distance.

The plates 30 and 32 of bracket 12 are also connected together by tubes 42 and 44. Rod 22 extends through tube 42 and is guided, and constrained to movement along its longitudinal axis, by bearings (not shown) within tube 42 near its upper and lower ends. The bearings are similar to those illustrated in U.S. Pat. No. 5,484,311. Rod 24 is similarly guided and constrained by bearings within tube 44. Bracket 10 is thus constrained to substantially vertical movement when bracket 12 is connected to the transom of a boat. The bearings within tubes 42 and 44, in cooperation with the rods 22 and 24, hold bracket 10 against translation relative to a substantially straight, vertical path. The vertical separation of the upper and lower bearings ensures that the bracket assembly will sustain the large moment imposed on it by the weight of the outboard motor.

As described in U.S. Pat. No. 5,484,311, graphite-impregnated synthetic resin seals prevent water and foreign objects from entering tubes 42 and 44, and also hold the bearings in place.

The vertical position of the motor bracket 10 relative to the transom bracket 12 is adjusted by a screw 46, which is threaded into plate 30, and rotated manually by means of a crank 48 located above plate 14 for easy accessibility.

Figure 3:
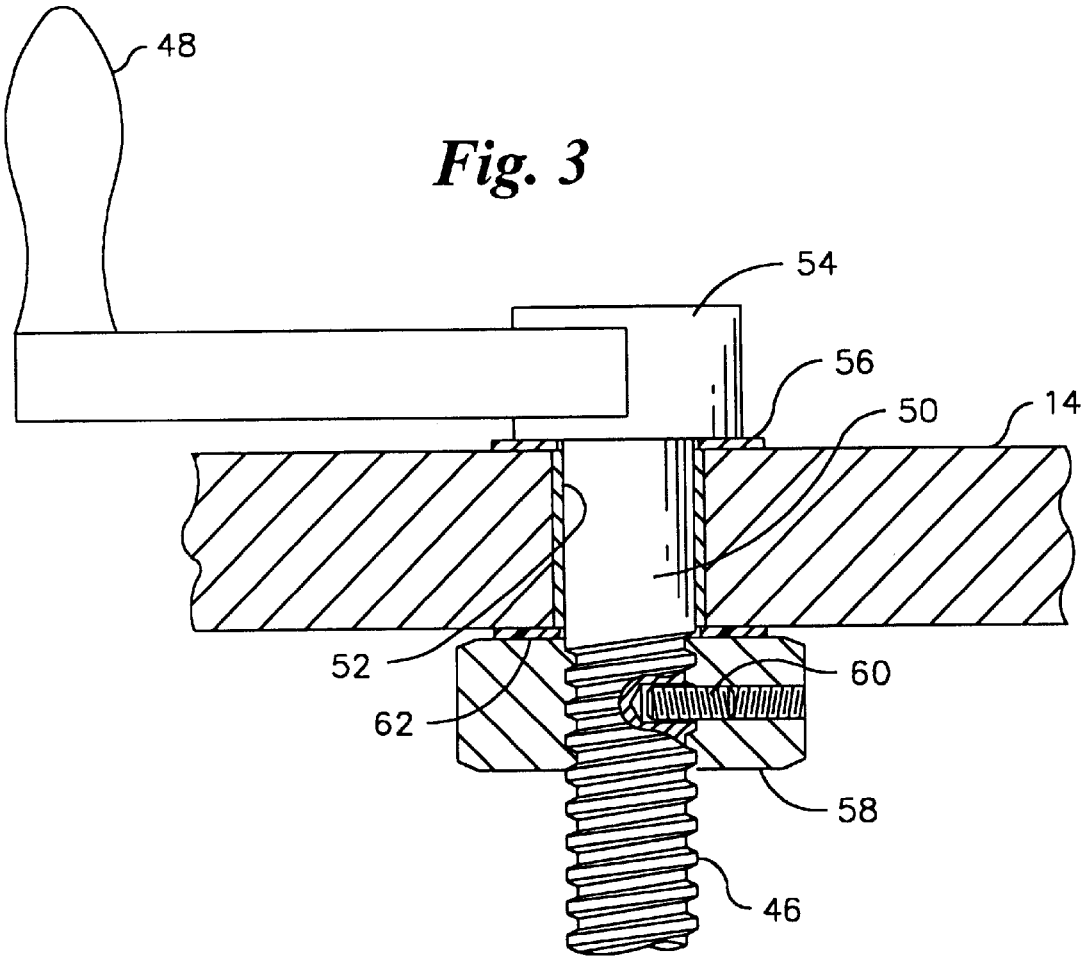
FIG. 3 is a fragmentary vertical section showing the manner in which the rod is journalled in a bearing in an upper plate of the first bracket.

As shown in FIG. 3, the screw 46 is a part of a shaft 50, which is journalled in a bearing 52 in plate 14. A head 54, to which the crank 48 is fixed, rests on a stainless steel washer 56 on the top of plate 14. A nut 58, secured in place on screw 46 by a set screw 60, is located underneath plate 14. A washer 62 is situated between nut 58 and the underside of plate 14. The head 54, the nut 58 and the two washers 56 and 62, together serve as a thrust bearing, holding the screw 46 against axial movement relative to plate 14, while allowing it to be rotated by crank 54. Washer 62 is preferably made from a low friction plastics material such as PTFE.

Figure 4:
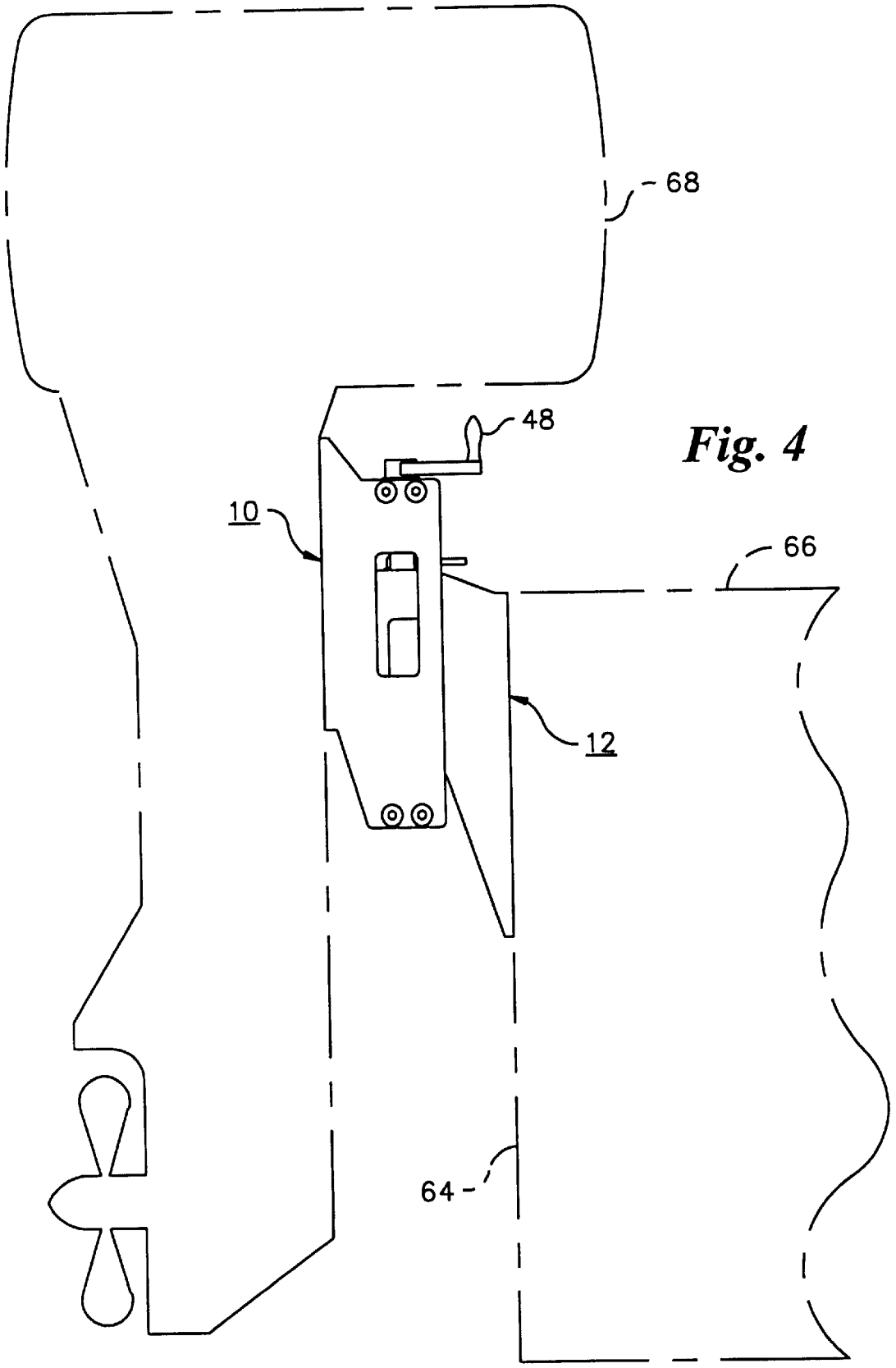
FIG. 4 is a side elevation showing the motor mount on the transom of a boat and supporting an outboard motor.

As illustrated in FIG. 4, bracket 12 is secured to the transom 64 of a boat 66, and an outboard motor 68 is connected to bracket 10. The vertical position of the outboard motor can be adjusted by crank 48 for optimum performance of the motor, under various operating conditions.

Figure 2:
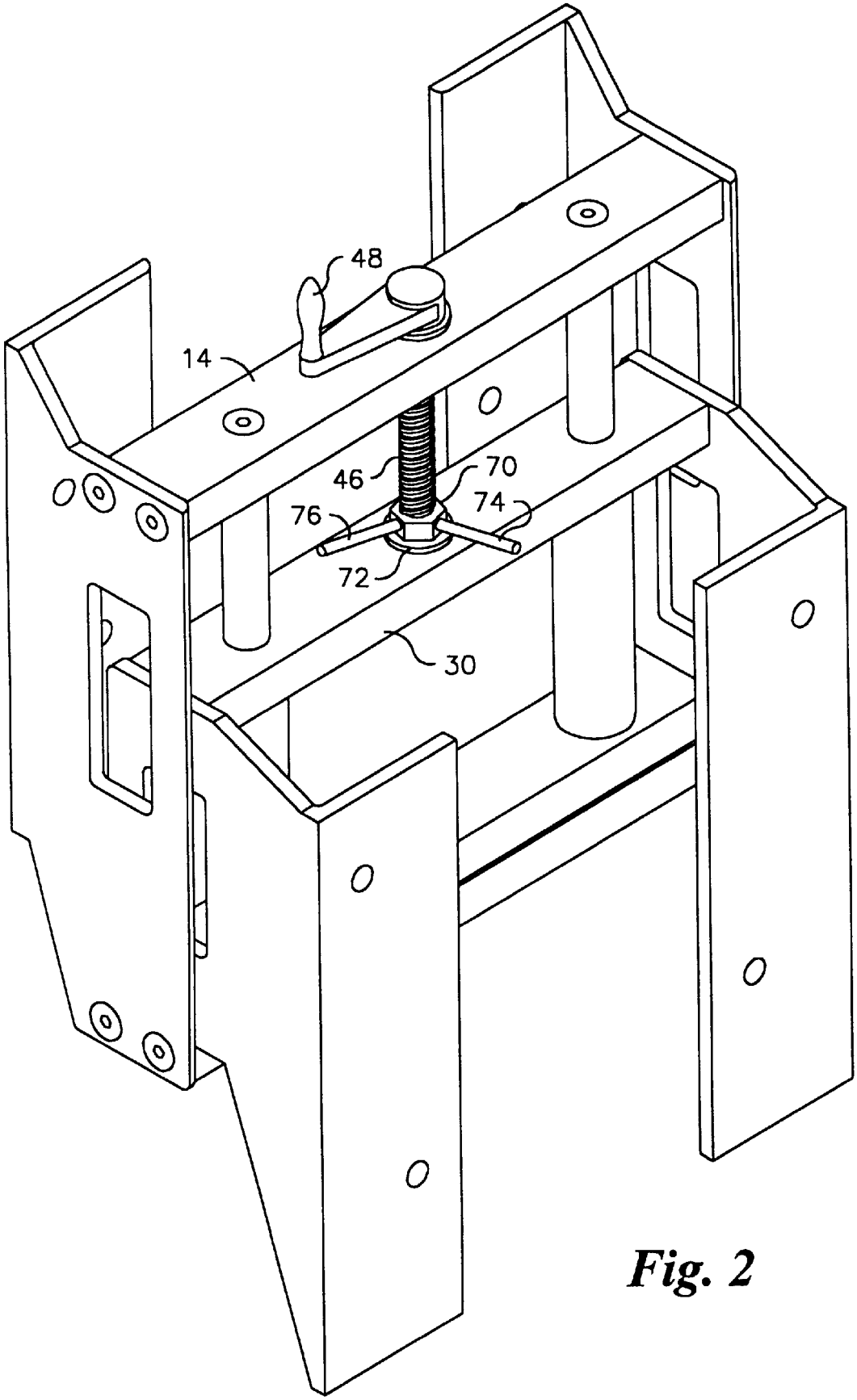
FIG. 2 is a similar perspective view, showing the motor mount in a lowered condition.

After the motor is adjusted to the desired position, the screw 46 is locked by tightening a nut 70, which is threaded onto screw 46, as shown in FIGS. 1 and 2. A washer 72 is located between the nut and the top of plate 30. Three radially extending arms, two of which are shown in FIG. 3 at 74 and 76, are provided at 120° intervals on nut 70, to permit manual rotation of the nut without the need for a wrench. The presence of three arms, disposed at 120° intervals, ensures that at least one arm will always be in a convenient position to be grasped. When the nut is tightened against washer 72, the axial force exerted by the nut on the threads of screw 46 results in increased friction, both at plate 30 and at plate 14, locking the screw against rotation, and preventing vibration from causing vertical drift of the outboard motor.

The motor mount in accordance with the invention provides for optimum efficiency in the operation of an outboard motor under various conditions by making it possible to vary the height of the motor. However, unlike prior adjustable motor mounts utilizing a closed loop servomechanism, the motor mount provides for convenient manual adjustment of the vertical position of an outboard motor, while also providing a simple and easily operated means for locking the motor supporting bracket against vertical drift.

With the adjusting screw journalled in the upper plate of the motor-supporting bracket, the adjusting crank travels vertically with the motor, and therefore allows the motor to move vertically through a wide range of positions without interfering with, or impeding access to, the crank. The rod and tube guide assemblies maintain the motor supporting bracket in a substantially vertical path, while providing a strong, rigid and vibration-resistant mount.

Various modifications can be made to the motor support described above. For example, although it is desirable to arrange the adjusting screw so that it is journalled in an element of the motor supporting bracket, the adjusting screw can be mounted in various other positions. For example, the adjusting screw can be journalled in an element of the transom bracket and threaded into an element of the motor supporting bracket. In another modification, the locking nut can be arranged so that, in its locked position, it bears against plate 14 instead of against plate 30. The nut can be made to bear against either side of either of either of plates 14 and 30. Although the crank 48 and the radially extending arms 72 and 74 are desirable because they obviate the use of a wrench, the screw 46 and the nut 70 can be rotated alternatively by a wrench or other suitable tool.

Still other modifications may be made to the apparatus and method described above without departing from the scope of the invention as defined in the following claims.

I claim:

1. A motor mount for adjustably supporting an outboard motor from a transom of a boat, the motor mount comprising:

first and second brackets;

means for connecting one of the brackets to a transom;

means for mounting an outboard motor to the other of the brackets;

guide means, connected to the first and second brackets, for constraining the brackets to relative movement in a substantially straight, path, the path being substantially vertical when said one of the brackets is connected to a transom by the connecting means;

means, connected to the first and second brackets, for effecting movement of the brackets relative to each other in said path;

in which the means for effecting movement of the brackets relative to each other in said path comprises a rod extending along a substantially vertical axis, the rod being journalled in the first bracket and having screw threads in threading engagement with threads of a threaded opening in the second bracket, a thrust bearing preventing axial translation of the rod relative to the first bracket, and means connected to the rod, for applying manual torque to the rod; and including a nut in threading engagement with the threads of the rod, and engageable with one of the first and second brackets, to lock the rod against rotation, whereby the first and second brackets may be locked against translation relative to each other;

in which the nut has three radially extending arms, each arm being disposed at an angle of 120 degrees relative to each of the other two arms.

2. A motor mount for adjustably supporting an outboard motor from a transom of a boat, the motor mount comprising:

first and second brackets;

means for connecting one of the brackets to a transom;

means for mounting an outboard motor to the other of the brackets;

guide means, connected to the first and second brackets, for constraining the brackets to relative movement in a substantially straight path, said path being substantially vertical when said one of the brackets is connected to a transom by the connecting means;

means, connected to the first and second brackets, for effecting movement of the brackets relative to each other in said path;

in which the first bracket comprises first and second plates disposed with the first plate above the second plate, and means rigidly connecting the first and second plates together;

in which the second bracket comprises third and fourth plates, the third plate being located above the fourth plate and the third and fourth plates being located between the first and second plates, and means rigidly connecting the third and fourth plates together;

in which the guide means comprises at least one elongated tubular member extending from the third plate to the fourth plate, and being rigidly connected to the third and fourth plates, a rod extending through the tubular member, the rod being rigidly connected to the first and second plates, and a pair of bearings mounted in the tubular member, the bearings being spaced from each other in the direction of the length of the tubular member, the rod extending lengthwise through the bearings and being slidable therein, the rod and tubular member being held by said bearings against relative lateral translational movement; and in which the means for effecting movement of the brackets relative to each other in said path comprises a rod extending along a substantially vertical axis, the rod being journalled in the first plate and having screw threads in threading engagement with threads of a threaded opening in the third plate, a thrust bearing preventing axial translation of the rod relative to the first plate, and a crank, located above the first plate and connected to the rod, for applying manual torque to the rod; and including a nut in threading engagement with the threads of the rod, and engageable with one of the first and third plates, to lock the rod against rotation, whereby the first and second brackets may be locked against translation relative to each other.

3. A motor mount according to claim 2 in which the nut is located on the rod between the first and second plates of the first bracket, and releasably tightenable against the first plate of the second bracket.

4. A motor mount according to claim 2 in which the first plate of the second bracket has a top surface, and in which the nut is located on the rod between the first and second plates of the first bracket, and releasably tightenable against said top surface.

5. A motor mount according to claim 2 in which the nut has at least one radially extending arm.

6. A motor mount according to claim 2 in which the nut has three radially extending arms, each arm being disposed at an angle of 120 degrees relative to each of the other two arms.

7. A motor mount according to claim 2 in which the means connected to the rod, for applying manual torque to the rod, is a crank fixed to the rod.

* * * * *